United States Patent [19]

Corbellini

[11] Patent Number: 4,957,598

[45] Date of Patent: Sep. 18, 1990

[54] SUCTION BOX COVER WITH MODULAR COMPONENTS

[76] Inventor: Glauco Corbellini, 33100 Via Carducci 48, Udine, Italy

[21] Appl. No.: 326,384

[22] Filed: Mar. 21, 1989

[30] Foreign Application Priority Data

Mar. 29, 1988 [IT] Italy ..... 83354 A/88

[51] Int. Cl.[5] ..... D21F 1/52

[52] U.S. Cl. ..... 162/363; 162/352; 162/374

[58] Field of Search ..... 162/352, 374, 363, 364, 162/353

[56] References Cited

U.S. PATENT DOCUMENTS

| | | | |
|---|---|---|---|
| 3,194,729 | 7/1965 | Robinson | 162/374 |
| 3,265,560 | 8/1966 | Sager | 162/374 |
| 3,645,844 | 2/1972 | Grenier | 162/374 |
| 3,741,866 | 6/1973 | Jud et al. | 162/374 |
| 3,836,428 | 7/1974 | McConaughy | 162/374 |
| 3,928,125 | 12/1975 | Poeschl | 162/374 |
| 3,953,284 | 4/1976 | Eralahti | 162/374 |

FOREIGN PATENT DOCUMENTS

| | | | |
|---|---|---|---|
| 637639 | 5/1950 | United Kingdom | 162/374 |

*Primary Examiner*—Karen M. Hastings

[57] ABSTRACT

The suction box cover able to support a stock wire (31) over it, the stock wire running as in the prior art of paper mill machinery, the suction box cover 10 having a frame structure constructed by external side member 11,111 and a plurality of blades 13, 14, 15, intermediate, front and back, including a carrier 18 and running blades 19 connected together, the blades 13, 14, 15 being the running table of the wire and being supported by a plurality of profiled or shaped staffs oriented orthogonally to the blades and connected to the external side members 11, 111. The suction box cover is closed at the sides by removable seals 29, and the suction box cover is connectable by means of the side members to a lower suction box 26. The connection between the intermediate blades 13 and staffs 12, between the front blade 14 and side member 11, the connection between the back blade 15 and the side member 111, the connection between the side members 11, 111 and a suction box 26 all being effected by connecting means which are readily releasable for disassembly for repair or replacement of parts.

9 Claims, 2 Drawing Sheets

SUCTION BOX COVER WITH MODULAR COMPONENTS

BACKGROUND OF THE INVENTION

In conventional paper mills it is known to use covers over a suction box. These covers operate in contact with the paper mill wire and are generally manufactured with a plurality of sliding blades crossing transversely to the speed direction, that is perpendicular to the direction of wire motion. The covers are is, perpendicular to the direction of wire motion. The covers are shaped so as to provide support for the wire. These sliding blades have changeable lengths adapted to various paper mill machine dimensions and are manufactured from many types of materials, sometimes compounded in a manner such that anti-wear materials are in contact with the wires and stronger materials form the carrier or support. The two parts are joined together by means of screws or inserts, or welded or glued, or by other techniques. These sliding blades are shaped and positioned so as to obtain formation of the sheet, and drainage is accomplished by the cover being coupled with an associated suction box.

The covers known in the prior are made to fit a single machine and are proportioned thereto not only in peripheral dimensions but in size and shape of various blade designs. This has the inconvenience each time the cover needs to be completed at the site of application for the particular machine.

These covers also have the inconvenience to present some difficulties in replacing parts, as is necessary when damage occurs to the cover surfaces during operation or during transportation of the cover and while it is being installed, especially when the installation site is far from the production plant.

These circumstances produce high cost in manufacturing and when damaged parts are replaced.

What is needed is a suction box cover composed of modular parts which can be assembled together to form the completed unit, the unit being capable of quick disassembly and parts replacement. That is to say, what is needed is a suction box cover for a paper mill formation table, that cover being manufactured with standardized modular parts dimensioned for assembly to accommodate the various dimensions required by the necessities of every type of stock wires which are used in paper mills, and said cover being easily disassembled for removal or parts replacement.

BRIEF DESCRIPTION OF THE INVENTION

The applicant has studied, experimented, and effected a suction box cover able to resolve all problems of the prior art, and having additional advantages.

The cover is composed of a structure which may be assembled and disassembled. The cover is made of various standardized elements, which are suitable for assembly in the dimensions of various paper mill designs and constructions. The cover is a modular structure able to form the desired sliding table for the wires, using crossing elements manufactured with composite materials and having a low thermal coefficient of elongation and providing high draining capacity for the sliding table.

The obtained cover in accordance with the invention has increased dimensional stability and is able to cooperate with a lower connected suction box. The cover in accordance with the invention is comprised of an essential basic frame made by two external side beams of effectively equal length connected to each other with a plurality of similar crossing staffs. The staffs are parallel to the wire moving direction and determine the spacing between the two external side beams. The staffs which are especially shaped, are fixed at their opposite ends to the side beams in a releasable manner. The staffs are in sufficient number to guarantee a stable structure. The side beam length determines the suction cover width transverse to the wire motion direction.

The staffs have contours on their upper faces in the form of recesses for holding therein intermediate sliding blades. The blades are disposed transversely, that is across the staffs and therefore the blades are parallel to the side beams and of corresponding length.

Differently shaped sliding blades are installed directly on top of the side beams in an easily releasable manner. That is, the sliding blade differs in contour from one side beam to the other side beam.

The intermediate sliding blades, that is, between the side beams are fastened to the shaped staffs by means of a dowel system which permits easy assembly and disassembly.

On the two lateral ends of the cover frame are provided sliding guides for installing seals for each blade. The seals are needed for maintaining the vacuum in the intermediate space of the cover under the wires during the drainage operation in paper making. The seals can be trimmed in the various positions at the side of the wire to conform with various paper widths. Simply stated, where drainage is not needed on the sliding table the spaces between the sliding blades are closed with removable seals.

In summary, a suction box cover is able to support a stock wire over it, the stock wire running as in the prior art of paper mill machinery, said suction box cover having a frame structure constructed by external side members and a plurality of blades intermediate, front and back blades including a carrier and running blade connected together, said blades being the running table of the wire and being supported by a plurality of profiled or shaped staffs oriented orthogonally to said blades and connected to the external side members. The suction box cover is closed at the sides by removable seals, and said suction box cover is connectable by means of the side members to a lower suction box. The connection between the intermediate blades and staffs, between the front blade and side member, the connection between the back blade and the subsequent side member, the connection between the side members and a suction box , all being effected by connecting means which are readily releasable for disassembly for repair or replacement of parts.

Accordingly, it is an object of this invention to provide an improved suction box cover which is of modular construction and can be assembled in any desired size from basic components.

Another object of the invention is to provide a suction box cover which is readily disassembled for transport and for repair when parts need replacement after wear or damage.

A further object of this invention is to provide an improved suction box cover which reduces the distance requirements for drainage of the sheet in paper making mills.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

Figure 1:
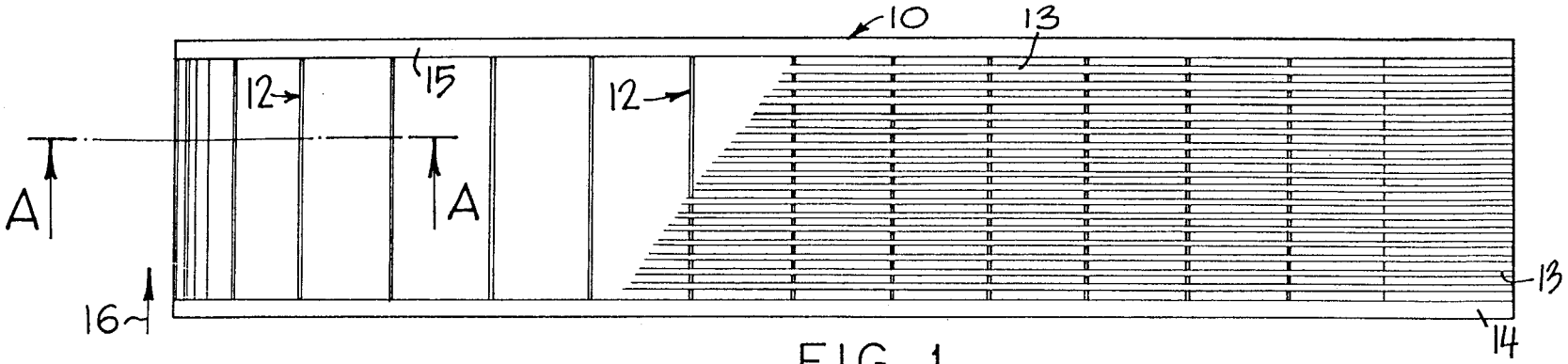
FIG. 1 is a plan view of a suction box cover with modular components in accordance with the invention.
Figure 3:
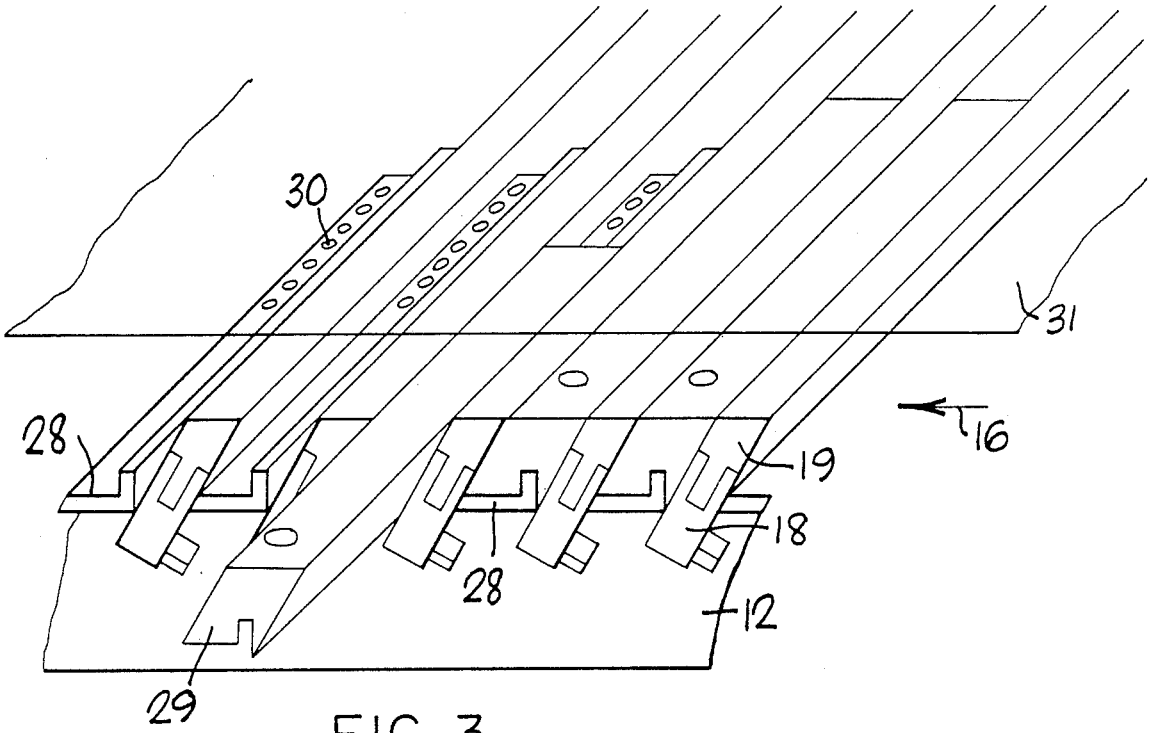
Figure 4:
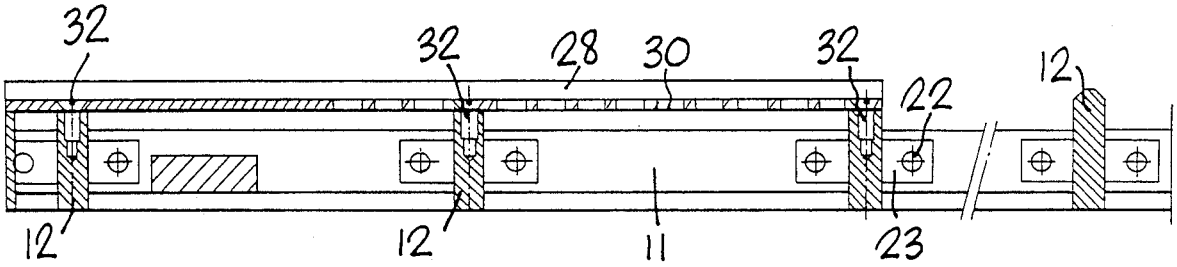
Figure 2D:
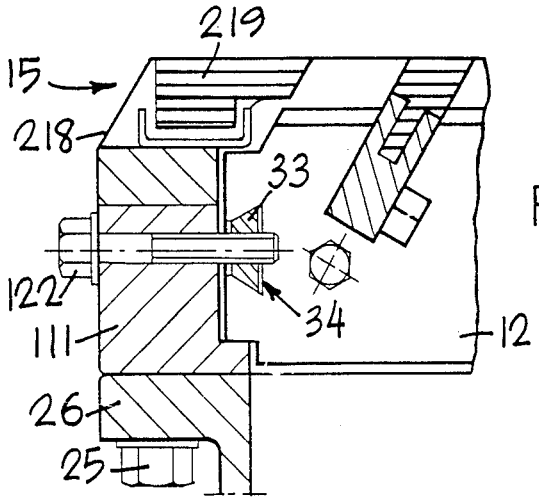

FIGS. *2a, 2b, 2c, 2d,* are alternative embodiments in accordance with the invention for attachment means used in the suction box cover with modular components;

FIG. 3 is a partial side perspective view of the suction box cover of FIG. 1;

FIG. 4 is a longitudinal section of the suction box cover of FIG. 1 taken along the line A—A.

DESCRIPTION OF THE PREFERRED EMBODIMENTS

With reference to the figures, a suction box cover 10 in accordance with the invention includes two side members or beams 11, 111 of a length suited to a particular paper mill and a plurality of shaped or contoured staffs 12 which cross the side members 11, 111 at right angles and span and determine the distance between the side members.

The shaped staffs 12 support a plurality of intermediate sliding blades 13 which are at right angles with the staffs 12. At the same time the side beams 11, 111, respectively directly support an anterior sliding blade 14 and a subsequent sliding blade 15. By anterior is meant that the pulp passes first over the sliding blade 14 and subsequently over the sliding blade 15 in the direction of its travel. The speed direction of the wire which is supporting pulp is indicated with an arrow 16 in FIGS. 1,2. Each shaped staff 12 includes a plurality of inclined slots 17 with a single intermediate blade 13 cradled o lodged in each slot 17. The intermediate blades 13 are advantageously made in several parts having a strong carrier 18 and a sliding body 19. The sliding body 19 which contacts the wire is generally made of ceramic and is connected to the carrier 18 by suitable means. The intermediate blades 13 are connected respectively to the shaped staffs 12 by means of slots 17 blanked into the staffs 12 and by suitable and readily removable means of rapid clamping for example springs or similarly elastic mean 20*a* which are inserted into the slots 17 via notches 20 and force the blade surfaces against the staff surfaces. In this way it is possible to accomplish rapid clamping and disassembling of the intermediate blades 13 from the slots 17 by removing the elastic means.

The front or anterior running blade 14 and the running subsequent blade 15 each have a carrier body, respectively 118, 218, and a sliding blade body, respectively 119, 219, attached to the associated carrier in a suitable manner. The front blade 14 and the subsequent blade 15 are each fixed to the associated side member or beam, respectively, 11, 111 with appropriate means such as screws, fixed joints, adhesives, or similar methods.

Figure 2:
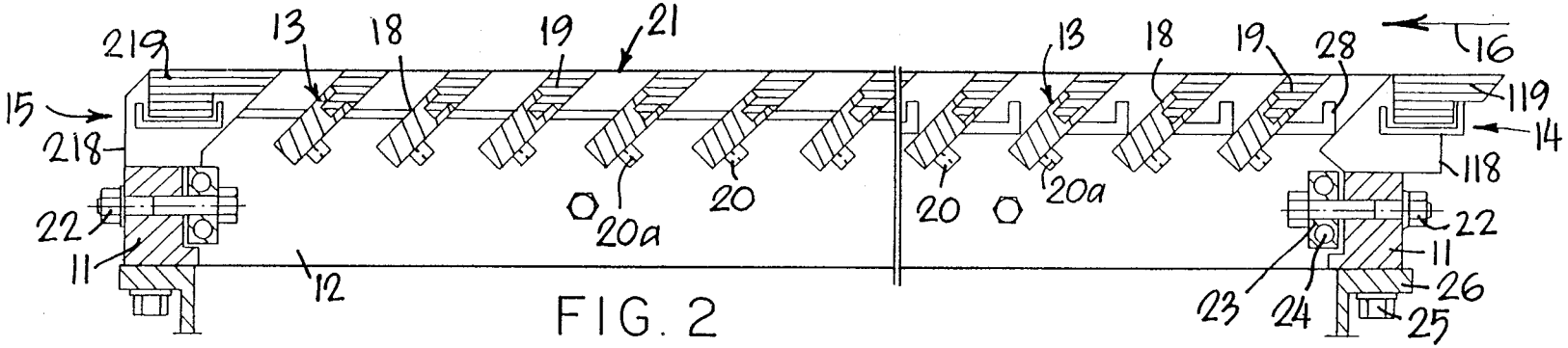
FIG. 2 is a sectional view of the suction box cover taken transversely to the running blades.
Figure 2C:
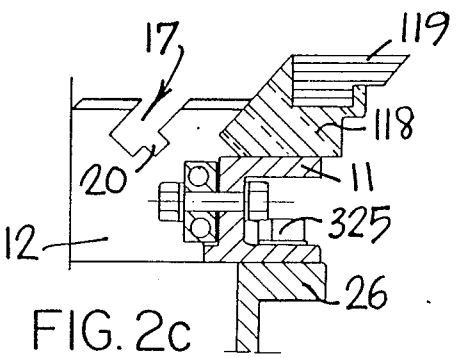
Figure 2B:
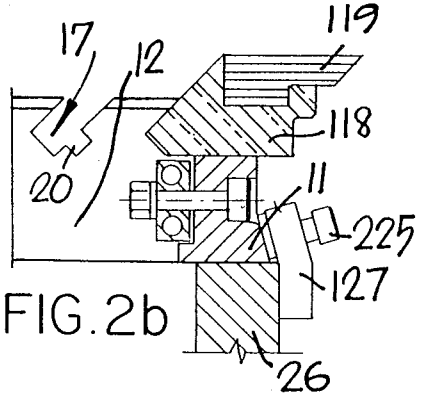
Figure 2A:
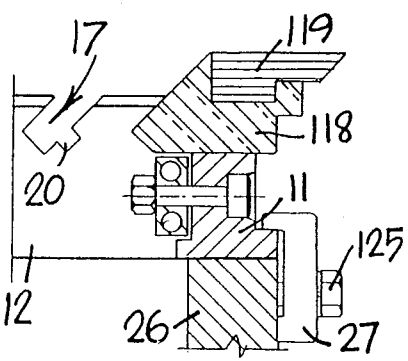

The upper surfaces of the sliding blades 119, 219 of the front side beam 14 and the subsequent beam 15 respectively, and the intermediate sliding blades 19 of the intermediate sliding blade carriers 13 are positioned so as to form a longitudinal sliding plane 21 for the wire associated thereto. In FIG. 2, the right portion of the section of the cover 10 represents the extremities, that is the right and left ends as viewed in FIG. 1, of the cover, while the left part of the figure is an intermediate zone of the suction box cover.

Each shaped staff 12 is fixed to the front beam 11 and to the subsequent beam 111, spanning the distance between the beams. Each staff 12 is especially shaped at its extremities for such attachment. Fixing bolts 22 pass through the beams 11, 111 and cooperate with threaded connecting lugs 23. Pins 24 pass removably through openings in the lugs and engage in aligned openings (not shown) in the side of the staff 12.

The side beams 11, 111 are fixed by means of bolts 25 to a suction box structure indicated at 26. FIGS. *2a, 2b, 2c,* are different constructions for attaching the staffs 12 and more particularly the side member or beams 11,111 to a suction box 26. In FIGS. *2a* and *2b,* the fastening operation is made by means of clamps 27, 127 respectively cooperating with suitable surfaces incorporated in the beams 11,111. Similar attachment is made at the beams 111 also. The bolts 125, 225 complete the attachment by passing through the clamps 27, 127 and engaging in the frame structure of the suction box 26 in FIG. *2a* and engaging the beam 11 in FIG. *2b.*

In FIG. *2c* attachment is made by passing a bolt 325 through a channel shaped beam 11 (111) into the suction box frame 26.

FIG. *2d* shows an alternative embodiment of an attachment configuration for joining the shaped staff 12 to the side beams 11, 111. A bolt 122 passes through side beam 111 and extends into a conical window or notch 34 made in the staff 12. A conically shaped key 33 is threaded onto the bolt 122 and is seated in the conical window 34 such that a connection is made between the staff 12 and the beam 111, said connection being reversible for maintenance purposes. A similar connection is used at the side beam 11.

Angle bars 28 are installed in parallel with the blades 13, 14, 15. The angle bars 28 are installed in the region of the lateral or side extremities of the wire (left and right ends as illustrated in FIG. 1). These angle bars 28 are for fixing seals 29 for the vacuum generated in the suction box 26. These angle bars 28 extend for a desired length in the spaces between the blades 13,14 and 15 and are continuous and parallel thereto. The angle bars 28 include a plurality of drainage holes 30 which are open to the inside of the suction box 26 for removal of water from the stock supported by the wire 31 as illustrated in FIG. 3. Seals 29 are especially shaped (FIG. 3) to slip over the angle bars 28 and fit between adjacent blades 13 and also adjacent to the anterior blade 14 and subsequent blade 15 forming a continuous surface with the surfaces of the sliding blades 19. The length of the seals 29 is adapted to the dimensions of the fiber sheet compared with the width of the wire 31. In FIG. 4, the left side shows a longitudinal section of the cover 10, the lateral side where seals 29 are located, while the right side in FIG. 4 shows a longitudinal section of intermediate portions between the sides of the cover 10 where the seals are not present and the drains 30 are open, this figure being a section made between two adjacent blades 13. Fixing screws 32 attach the angle bars 28 to the shaped staffs 12.

Thus, it can be seen that the entire structure is held together by bolts, friction fits held by elastic means, engaging keys and pins etc. such that the entire assembly may be readily assembled and disassembled. Additionally, the cover width in a direction transverse to the arrow 16 is determinable by selecting the length of the side members 11, 111 and using a suitable number of staffs 12 to provide proper support for the wire. Covers 10 can be located adjacent each other in the direction of the arrow 16 to increase the length of the suction cover in that direction.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense. It is also to be understood that the following claims are intended to cover all of the generic and specific features of the invention herein described, and all statements of the scope of the invention which, as a matter of language, might be said to fall therebetween.

What is claimed is:

1. A modular-type suction box cover having sides for supporting a wire for paper mill stock, and comprising; a frame structure including external side beams, a plurality of sliding blades including a front sliding blade, intermediate sliding blades, and a subsequent sliding blade, each blades being constructed of a carrier connected to a sliding body which contacts the wire, said blades being a sliding surface for said wire, and are supported from a plurality of shaped staffs, each shaped staff having a plurality of inclined slots, each inclined slot having a single sliding blade lodged therein, and having a small notch intersecting said slot and cooperatively associated with elastic fastening means for clamping and forcing said blade against said shaped staff, each blades being at right angles to said shaped staffs, and each said shaped staff standing the distance between and connecting said external side beams, said cover being sealed at the sides by seals and is secured by means of said beams to a lower suction box, and elastic fastening means between the intermediate sliding blades and said shaped staff, fastening means between the front sliding blade with one of said side beams, fastening means between the subsequent sliding blade with another of said side beams, fastening means between the shaped staffs with said side beams, and fastening means between the side beams with said lower suction box, all said fastening means being releasable so that such components of said suction box cover which are modular in form may be readily assembled to and disassembled from the lower suction box for ease of repair and replacement of parts.

2. The suction box cover according to claim 1, wherein the fastening means between said shaped staffs and said side beams comprises screws in cooperation with connecting means fixed at said staffs with pins.

3. Suction box cover according to claim 1, wherein the fastening means between said shaped staffs and the side beams comprises screws cooperating with conic keys insertable in conic windows formed in the ends of said shaped staffs.

4. The suction box cover according to claim 1, wherein the fastening means between the front sliding blade, the subsequent sliding blade and said side beams respectively comprises screws.

5. The suction box cover according to claim 1, wherein the fastening means between the front sliding blade, the subsequent sliding blade and said side beams respectively comprises clamp means.

6. The suction box cover according to claim 1, wherein the fastening means between the side beams and said lower suction box comprises screw means.

7. The suction box cover according to claim 1, wherein the fastening means between said side beams and said lower suction box comprises clamps and pressure screws.

8. The suction box cover according to claim 1, further including at the extremities of said suction box cover angle bars with cooperating seals between said sliding blades.

9. The suction box cover according to claim 8, wherein said angle bars have a plurality of holes for drainage of water from said wire to said lower suction box.

* * * * *